US008235504B2

(12) United States Patent
Takaoka et al.

(10) Patent No.: US 8,235,504 B2
(45) Date of Patent: Aug. 7, 2012

(54) INKJET HEAD, INKJET APPARATUS, AND INKJET APPARATUS PRODUCTION METHOD

(75) Inventors: Tsubasa Takaoka, Tokyo (JP); Isao Imamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 13/013,283

(22) Filed: Jan. 25, 2011

(65) Prior Publication Data

US 2011/0181665 A1 Jul. 28, 2011

(30) Foreign Application Priority Data

Jan. 27, 2010 (JP) ..... 2010-015853

(51) Int. Cl.
*B41J 2/14* (2006.01)
*B41J 2/16* (2006.01)

(52) U.S. Cl. ..... 347/50; 347/58

(58) Field of Classification Search ..... 347/40–44, 347/49–50, 58, 64, 84–86
See application file for complete search history.

(56) References Cited

U.S. PATENT DOCUMENTS 3,278,457 A 10/1966 Milgrom
3,632,557 A 1/1972 Brode
5,650,805 A 7/1997 Shimomura et al.
6,905,342 B2 * 6/2005 Swier et al. ..... 439/65

FOREIGN PATENT DOCUMENTS

JP 46-27250 B 8/1971
JP 46-30711 B 9/1971
JP 4-145123 A 5/1992
JP 7-232439 A 9/1995
JP 2002-179787 A 6/2002
JP 2002-356550 A 12/2002
JP 2003-193019 A 7/2003

* cited by examiner

*Primary Examiner* — Thinh Nguyen
(74) *Attorney, Agent, or Firm* — Canon U.S.A., Inc., IP Division

(57) ABSTRACT

An inkjet head includes a discharge element substrate including a base material provided with an energy generation element for generating energy to be used for discharging ink, a discharge port provided corresponding to the energy generation element, and an electrode pad electrically connected to the energy generation element, an electric contact substrate including an electric contact terminal for receiving an electric signal from an inkjet apparatus, and an electric wiring tape for electrically connecting the electric contact substrate and the discharge element substrate to each other, wherein a sealing member sealing a vicinity of an electric connection portion between the electric contact substrate and the electric wiring tape is a cured product of a composition including a silicone-modified resin, a boron trifluoride compound, and a mercaptosilane compound.

5 Claims, 10 Drawing Sheets

INKJET HEAD, INKJET APPARATUS, AND INKJET APPARATUS PRODUCTION METHOD

BACKGROUND OF THE INVENTION

1. Field of the Invention

The present invention relates to an inkjet head, an inkjet apparatus, and a method for producing the inkjet apparatus.

2. Description of the Related Art

An inkjet head is mounted to a recording apparatus and performs recording by discharging an ink on a recording medium such as a paper sheet.

Japanese Patent Application Laid-Open No. 7-232439 discusses a use of a moisture-curable material containing as abase resin silicone-modified polyetherpolyol as a sealant for a liquid ink use unit of an inkjet head. A silicone compound having at an end of its molecule an alkoxy group that is easily hydrolyzed is added to the silicone-modified polyetherpolyol for the purpose of imparting a moisture-curing property. The alkoxy group is changed into silanol through decomposition by moisture. Since silanol is unstable, silanol is turned into a gel by addition of a slight amount of a catalyst such as organic tin for polymerization of silanol.

In recent years, to improve the image quality of a recorded image, materials to be used for ink have become versatile. Also, in an electric connection unit of an electric wiring tape that is electrically connected to a substrate having a discharge port and an element for generating energy for discharging ink, a protection film of a surface of the electric wiring tape generally has low adhesiveness to a resin material.

Therefore, there is a concern that the sealing member discussed in Japanese Patent Application Laid-Open No. 7-232439 can be detached when contacting ink depending on a material of a sealing portion and the type of the ink.

SUMMARY OF THE INVENTION

The present invention is directed to an inkjet head improved in reliability of a sealing portion in the vicinity of an electric connection portion.

The present invention is further directed to an inkjet apparatus to which the highly reliable inkjet head that is improved in reliability of the sealing portion in the vicinity of the electric connection portion is mounted.

According to an aspect of the present invention, an inkjet head includes a discharge element substrate including a base material provided with an energy generation element for generating energy to be used for discharging ink, a discharge port provided corresponding to the energy generation element, and an electrode pad electrically connected to the energy generation element, an electric contact substrate including an electric contact terminal for receiving an electric signal from an inkjet apparatus, and an electric wiring tape for electrically connecting the electric contact substrate and the discharge element substrate to each other, wherein a sealing member sealing a vicinity of an electric connection portion between the electric contact substrate and the electric wiring tape is a cured product of a composition including a compound having a structure represented by Formula (1), a boron trifluoride compound, and a mercaptosilane compound:

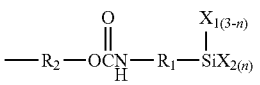

(1)

where n is 1 or more and 3 or less; $X_1$ is a substituted or unsubstituted organic group having 1 to 20 carbon atoms; $X_2$ is a hydrolyzable group; $R_1$ is a divalent organic group having a molecular weight of 1000 or less; and $R_2$ is at least one selected from the group consisting of polyoxyalkylene, a saturated hydrocarbon polymer, a vinyl polymer, polyester, and polycarbonate.

According to an exemplary embodiment of the present invention, it is possible to provide a highly reliable inkjet head improved in reliability of a sealing portion in the vicinity of an electric connection portion and an inkjet apparatus to which the inkjet head is mounted.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1A:
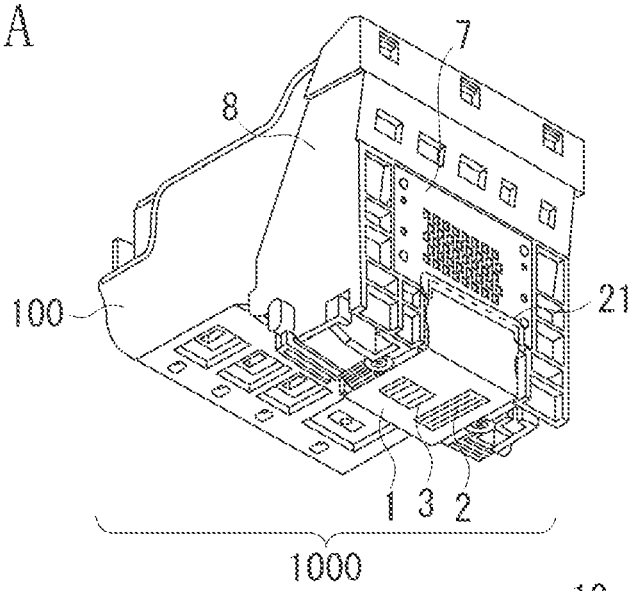
FIGS. 1A and 1B are perspective views illustrating an inkjet head according to an exemplary embodiment of the present invention.
Figure 1B:
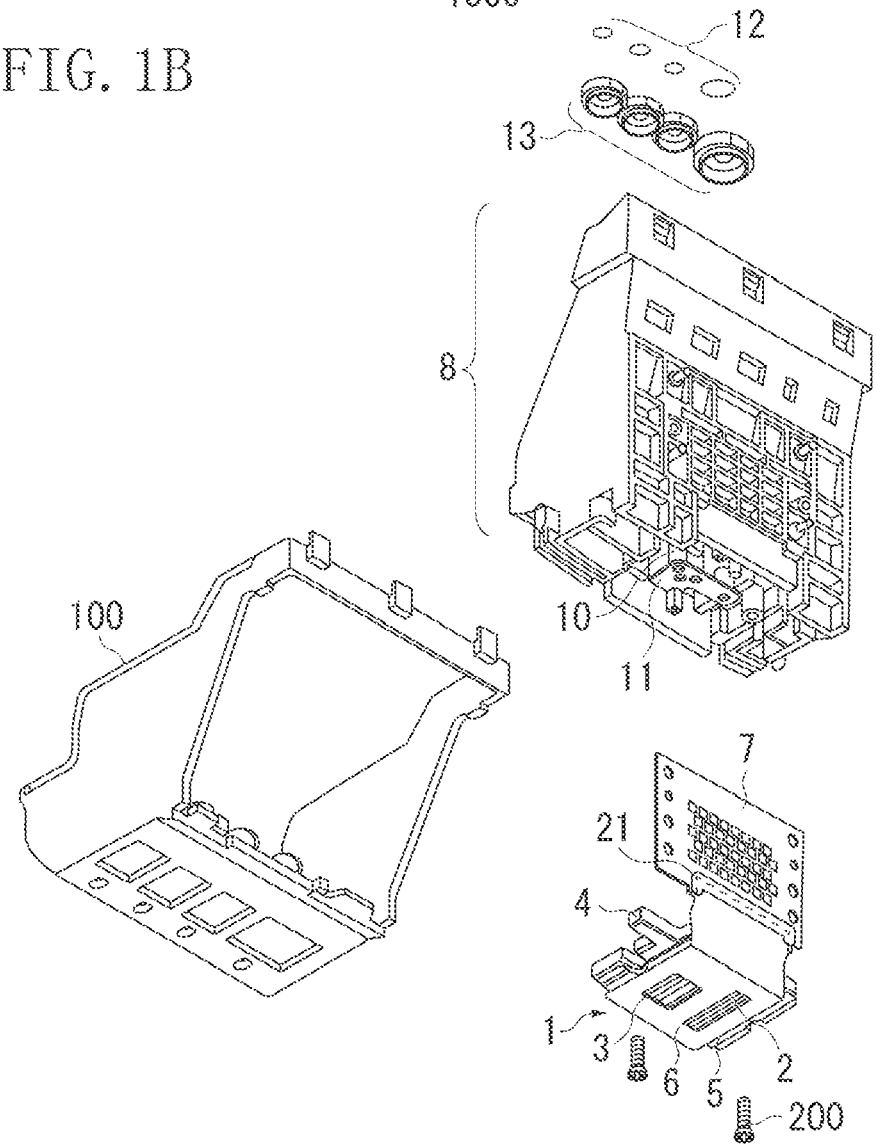
Figure 2:
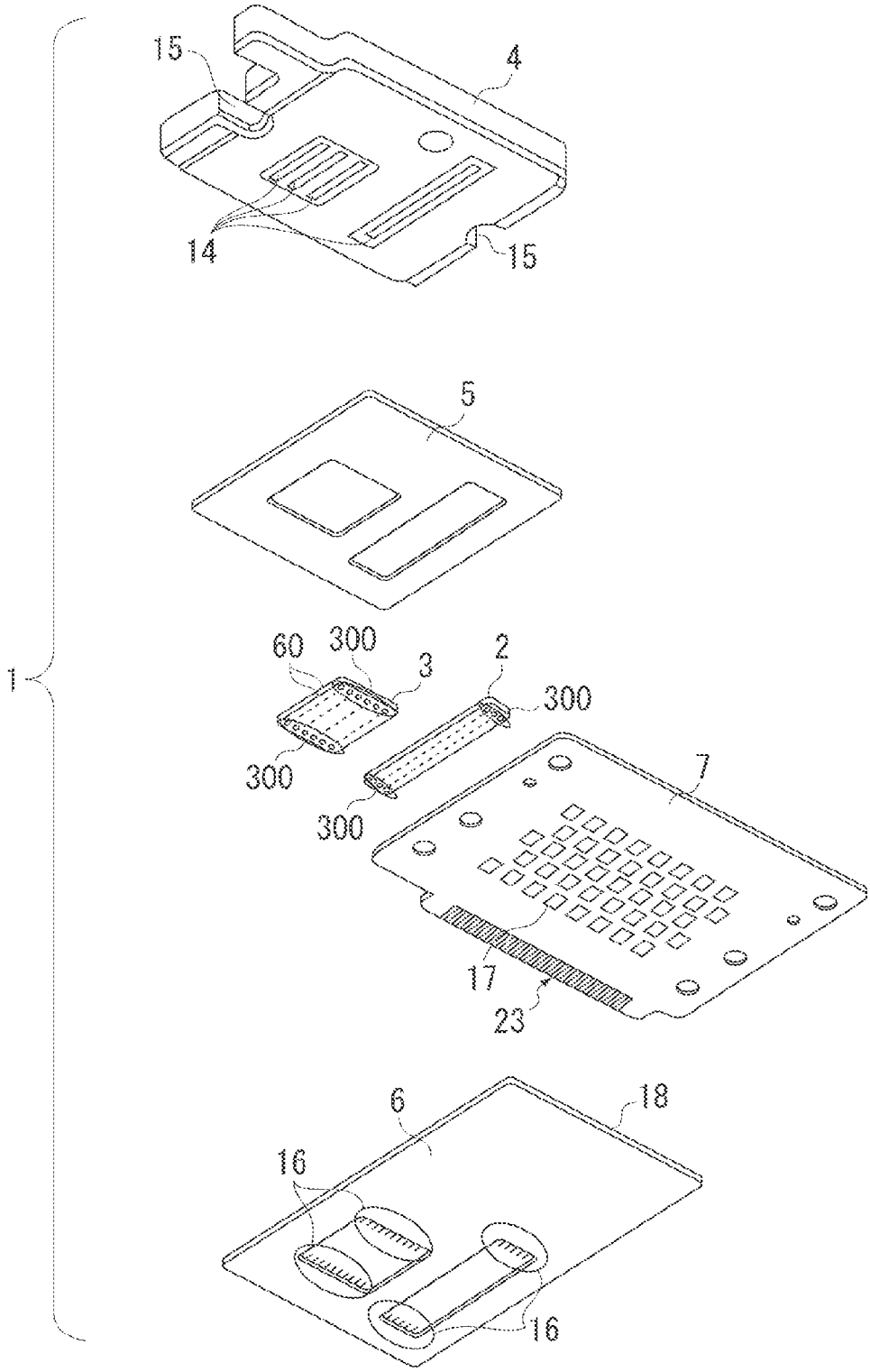
FIG. 2 is a perspective view in which a discharge element unit illustrated in FIGS. 1A and 1B is exploded.
Figure 4:
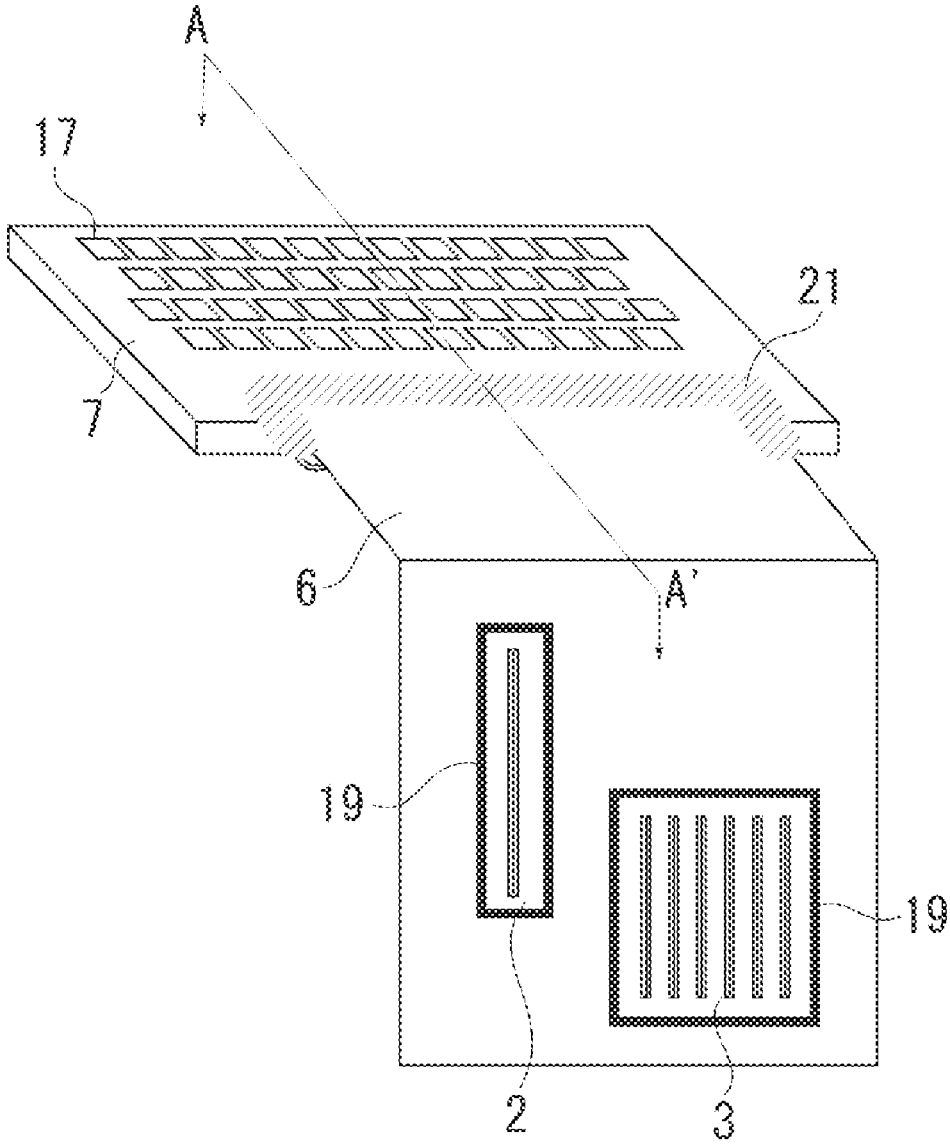
FIG. 4 is an enlarged perspective view schematically illustrating a sealing portion between the electric wiring tape and the electric contact substrate.
Figure 5:
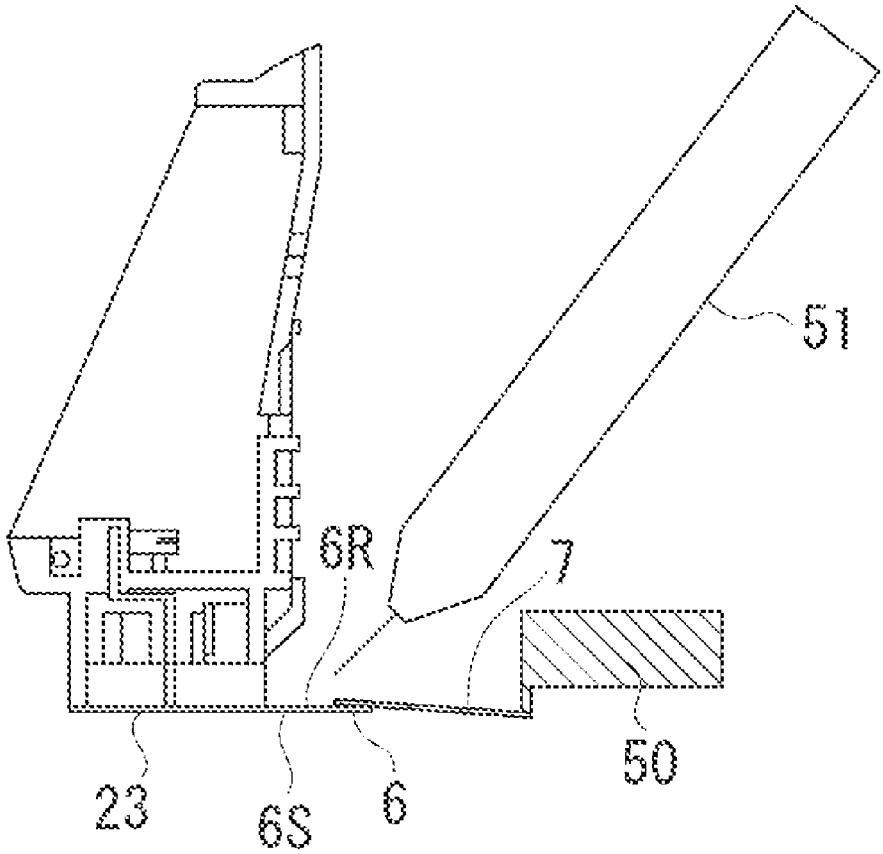
FIG. 5 is a side view illustrating an example of a method for producing the inkjet head according to an exemplary embodiment of the present invention.

FIGS. 1A and 1B are a perspective view and an exploded perspective view illustrating a configuration example of an inkjet head according to an exemplary embodiment of the present invention. FIG. 2 is a perspective view in which a discharge element unit 1 illustrated in FIGS. 1A and 1B is exploded. FIG. 4 is an enlarged perspective view schematically illustrating a connection portion on a surface side between an electric wiring tape 6 and an electric contact substrate 7.

As illustrated in FIG. 1A and FIG. 1B, which is an exploded perspective view of the inkjet head 1000 illustrated in FIG. 1A, the inkjet head 1000 includes an ink supply unit 8, a tank holder 100, and the discharge element unit 1. The discharge element unit 1 includes a first discharge element substrate 2, a second discharge element substrate 3, a first plate 4, the electric wiring tape (electric wiring substrate) 6, an electric contact substrate 7, and a second plate 5. The first and second discharge element substrates 2 and 3 are provided with energy generation elements for generating energy to be used for discharging ink and ink discharge ports corresponding to the energy generation elements. The ink supply unit 8 includes an ink supply member 9, a flow path forming member 10, a joint sealing member 11, a filter 12, and a sealing rubber 13. A support member 4 is fixed to the ink supply unit 8 by screws 200. A vicinity of an electric connection portion between the electric contact substrate 7 and the electric wiring tape 6 is sealed by a sealing member 21.

As illustrated in FIG. 2, a supply path for supplying black ink to the first discharge element substrate 2 and supply paths for supplying cyan, magenta, and yellow inks to the second discharge element substrate 3 are formed as ink supply paths 14 on the first plate 4. Also, a screw-fastened portion 15 for connection to the ink supply unit 8 is formed on each of opposite sides. The first and second discharge element substrates 2 and 3 are provided with ink discharge ports 60, which are openings corresponding to the energy generation elements (not illustrated) for generating energy to be used for discharging inks.

Figure 10:
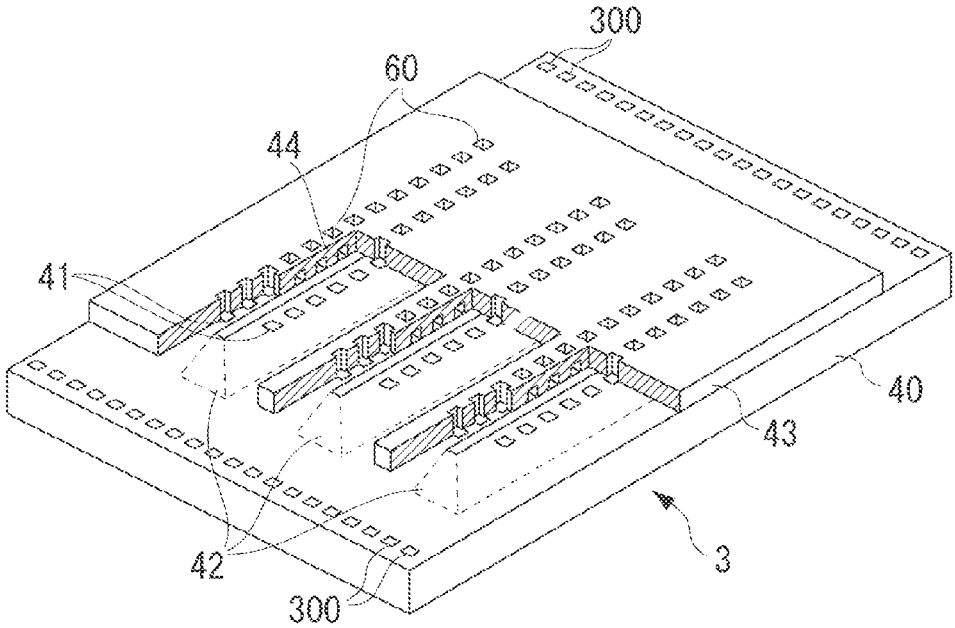
FIG. 10 is a perspective view schematically illustrating a discharge element substrate according to an exemplary embodiment of the present invention.

FIG. 10 is a perspective view schematically illustrating the discharge element substrate 3 according to an exemplary embodiment of the present invention. The discharge element substrate 3 has a base material 40 made from silicon or the like and provided with energy generation elements 41 for generating energy to be used for discharging inks and a discharge port member 43 provided with the ink discharge ports 60. The base material 40 is provided with an electrode pad 300 and ink supply ports 42 communicating with ink flow paths 44, which lead to the discharge ports 60, to provide communication with the supply paths 14 of the first plate 4.

The second plate 5 has the shape of having two openings that are larger than the outside dimensions of the first discharge element substrate 2 and the second discharge element substrate 3, which are adhesion-fixed to the first plate 4 with a first adhesive agent. The second plate 5 is fixed to the first plate 4 with a second adhesive agent. Thus, it is possible to electrically connect the electric wiring tape 6 to the first discharge element substrate 2 and the second discharge element substrate 3 by the contact on an adhesion plane when the electric wiring tape 6 is bonded to the second plate 5.

The electric wiring tape 6 forms an electric signal path for applying an electric signal for causing ink to be discharged to the first discharge element substrate 2 and the second discharge element substrate 3. Two openings corresponding to the discharge element substrates 2 and 3 are formed on the electric wiring tape 6. An electrode terminal 16 to be connected to the electrode pad 300 of each of the discharge element substrates 2 and 3 is formed in the vicinity of edges of each of the openings. The electrode pad 300 is electrically connected to the energy generation elements for generating energy to be used for discharging inks, and the energy for discharging inks is transmitted from the electrode pad 300 to the discharge element substrates. At one end portion of the electric wiring tape 6, a second electric connection terminal portion 18 for electrically connecting a first electric connection terminal portion 23 of the electric contact substrate 7 having the electric contact terminal 17 serving to input an external signal for receiving the electric signal is formed. The electric terminals 16 and the second electric connection terminal portion 18 are connected via a continuous copper foil wiring pattern. A reverse side of the electric wiring tape 6 is adhesion-fixed to a lower surface of the second plate 5 with a third adhesive agent, and the electric wiring tape 6 is bent toward one side of the first plate 4 and adhesion-fixed to the side of the first plate 4 with a fourth heat-curable adhesive agent.

The electric connection between the electric wiring tape 6 and the first discharge element substrate 2 and the second discharge element substrate 3 is attained by electric bonding of the electrode pads 300 of the discharge element substrates 2 and 3 to the electrode terminals 16 of the electric wiring tape 6 by a thermal ultrasonic compression bonding.

As illustrated in FIG. 4, the sealing member 21 covers a surface of the electric wiring tape formed from a polyimide film or the like and a surface and a side face (glass epoxy resin or the like) of the electric contact substrate formed from an acryl resin, an acrylic resin such as epoxy acrylate, or the like. Examples of a polyimide compound usable for the surface of the electric wiring tape 6 include Upilex (manufactured by Ube Industries, Ltd.). Examples of the acrylic resin applicable for the film of the surface covering the wiring portion of the electric contact substrate include PSR-4000 (manufactured by Taiyo Ink Mfg, Co., Ltd.). The connection portion between the electric wiring tape 6 and the surface side of the electric contact substrate 7 is subject to exposure to inks since the inks retained on the ink discharge port surfaces flow thereto due to capillary action. The electric connection portions between the first discharge element substrate 2 or the second discharge element substrate 3 and the electric wiring tape 6 may be sealed by a heat-curable sealant 19.

Figure 3:
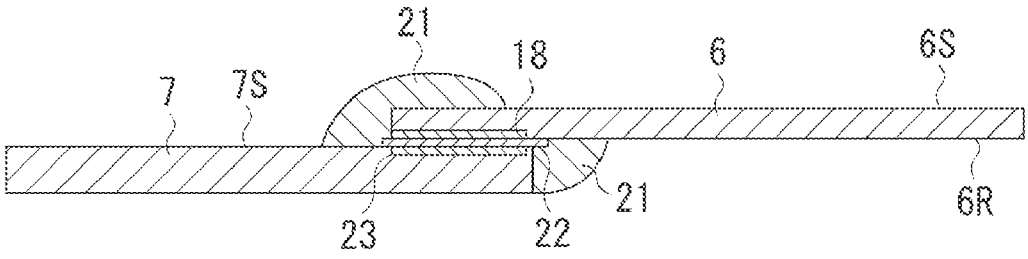
FIG. 3 is a sectional view illustrating a state of an electric wiring tape and an electric contact substrate after thermocompression bonding.

FIG. 3 is a sectional view illustrating a section of the discharge element unit taken along line A-A' illustrated in FIG. 4 and perpendicular to the electric contact substrate. As illustrated in FIG. 3, the electric contact substrate 7 is electrically connected to the end portion of the electric wiring tape 6 by thermal compression bonding using an anisotropically conductive film 22 or the like. The sealing member 21 is mainly used for sealing a vicinity portion including a reverse side and a surface side of an electric connection portion between the second electric connection terminal portion 18 of the electric wiring tape 6 and the connection terminal 23 of the electric contact substrate 7. The sealing member 21 is provided on an area from a first surface 6S of the electric wiring tape 6 to a third surface 7S of the electric contact substrate 7 and continuously on a side face of the electric wiring tape 6 and a second surface 6R (side close to the supply unit), which is the reverse side of the electric wiring tape 6. Examples of a material applicable for the reverse side 6R of the electric wiring tape 6 include aromatic polyamide. The sealing member 21 is a cured product of a composition containing a) a compound having a structure represented by Formula (1), b) a boron trifluoride compound, and c) a mercaptosilane compound:

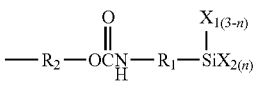

(1)

where n is 1 or more and 3 or less; $X_1$ is a substituted or unsubstituted organic group having 1 to 20 carbon atoms; $X_2$ is a hydrolyzable group; $R_1$ is a divalent organic group having a molecular weight of 1000 or less; $R_2$ is at least one selected from the group consisting of polyoxyalkylene, a saturated hydrocarbon polymer, a vinyl polymer, polyester, and polycarbonate).

Hereinafter, a composition of the sealing member 21 before curing will be described. In the composition of the sealing member 21 before curing, a) the compound having the structure represented by Formula (1) is a silicone-modified resin obtained by silicone modification of an end of an organic polymer compound for imparting a moisture-curing property to the organic polymer compound. By the addition of silicone having a hydrolyzable group to an end of a molecule, the hydrolyzable group is changed into silanol through decomposition by moisture. The silanol is considerably unstable and has the property of gelling by polymerization by addition of a slight amount of a catalyst. To impart the moisture-curing property to general organic polymer compounds, the modification using the silicone compound having the hydrolyzable group in the polymer is performed.

A method for introducing the hydrolyzable group $X_2$ is not particularly limited. The most simple silicone modification method may be a method of adding a silane coupling agent. Since the silane coupling agent has in its molecule a hydrolyzable group and a reaction group that reacts with an organic polymer compound, it is possible to easily modify the organic polymer compound into a moisture-curable compound. Examples of the hydrolyzable group include an alkoxy group, an acyloxy group, a ketoxymate group, an amino group, an amide group, an acid amide group, an aminooxy group, a mercapto group, an oxime group, and alkenyloxy group as well as a hydrogen atom and a halogen atom. Among the above, the hydrogen atom, alkoxy group, acyloxy group, ketoxymate group, amino group, amide group, acid amide group, aminooxy group, mercapto group, oxime group, and alkenyloxy group are preferred, and, from the viewpoint of high reactivity, suppressed odor, and the like, the alkoxy group is particularly preferred. As the alkoxy group, the alkoxy group having 1 to 12 carbon atoms is preferred, and a methoxy group and an ethoxy group are particularly preferred. Hydrolyzable groups in a bifunctional or trifunctional hydrolyzable silyl group maybe the same or different, and the hydrolyzable silyl groups in the compound represented by Formula (1) maybe the same or may include various types of groups. A combination of different types of curable resins such as a combination of a bifunctional resin and a trifunctional resin may be used.

Examples of the silane coupling agent include vinylsilane such as vinyltrichlorosilane, vinyltrimethoxysilane, and vinyltris(2-methoxyethoxy)silane; methacrylsilane such as 3-methacryloxypropyltrimethoxysilane; epoxysilane such as 3-glycidoxypropyltrimethoxysilane and 2-(3,4-epoxycyclohexyl)ethyltrimethoxysilane; 3-aminopropyltriethoxysilane; N-2-(aminoethyl)-3-aminopropyltrimethoxysilane; aminosilane such as N-2-(aminoethyl)-3-aminopropylmethyldimethoxysilane, N-phenyl-3-aminopropyltrimethoxysilane; mercaptosilane such as 3-mercaptopropyltrimethoxysilane; and the like.

A method for introducing a urethane bond is not particularly limited. A linking group generated when linking a plurality of raw materials by a chemical reaction may be the urethane bond, or a compound having the urethane bond may be linked by a chemical reaction.

However, when it is desired to obtain a sealing member having stable viscosity and tack-free time, it is necessary to add the hydrolyzable silyl group to the organic polymer under the conditions of not causing decomposition of the hydrolyzable group. In other words, since the hydrolyzable group added to the silicon atom has the considerably unstable property of being decomposed in the presence of a slight amount of moisture, it is necessary to set reaction conditions and a molecular structure that enables an addition reaction of the hydrolyzable silyl group to the organic polymer compound.

As the most suitable method, the method of using polyvalent isocyanate described in Japanese Patent Publication No. 46-307711 may be employed. Isocyanate has a high reaction property with active hydrogen of a hydroxy group or an amino group and generates a urethane bond or a urine bond. With the property, it is possible to add the hydrolyzable silyl group to the organic polymer.

Examples of organic polyisocyanate which is the polyvalent isocyanate used in the present exemplary embodiment include trimethylenediisocyanate, tetramethylenediisocyanate, hexamethylenediisocyanate, pentamethylenediisocyanate, 1,2-propylenediisocyanate, 1,2-butylenediisocyanate, 2,3-butylenediisocyanate, 1,3-butylenediisocyanate, and 2,4,4- or 2,2,4-trimethylhexamethylenediisocyanate. Other examples of the organic polyisocyanate include aliphatic diisocyanate such as 2,6-diisocyanatemethylcaproate including 1,3-cyclopentanediisocyanate, 1,4-cyclohexanediisocyanate, and 1,3-cyclohexanediisocyanate.

Yet other examples of the organic polyisocyanate include alicyclic diisocyanate such as 1,3-bis(isocyanatemethyl)cyclohexane including m-phenylenediisocyanate and p-phenylenediisocyanate; aromatic diisocyanate such as 4,4'-diphenyletherdiisocyanate; araliphatic diisocyanate such as 1,3- or 1,4-bis(1-isocyanate-1-methylethyl)benzene and a mixture thereof; organic triisocyanate such as 1,3,5-triisocyanatebenzene and 2,4,6-triisocyanatetoluene; a polyisocyanate monomer of organic tetraisocyanate such as 4,4'-diphenyldimethylmethane-2,2',5,5'-tetraisocyanate; a dimmer, a trimer, a biuret, an allophanate derived from the polyisocyanate monomer; polyisocyanate having a 2,4,6-oxadiazinetrione ring obtained from a carbonate gas and the polyisocyanate monomer; and an adduct with a low molecular weight polyol having a molecular weight of less than 200, such as ethyleneglycol and propyleneglycol.

Examples of a main chain skeleton of the silicone-modified resin include polyoxyalkylene, a saturated hydrocarbon polymer, a vinyl polymer (e.g., copolymer of acryl monomer), polyester, and polycarbonate. The main chain skeleton may more preferably be polyoxyalkylene, a saturated hydrocarbon polymer, or a vinyl polymer, further preferably polyoxyalkylene or a vinyl polymer.

As the polyoxyalkylene polymer to be the main chain skeleton, those produced by a reaction between an initiator and monoepoxide or the like in the presence of a catalyst are preferred. As the initiator, a hydroxy compound having one or more hydroxyl groups or the like may be used.

As the monoepoxide, ethylene oxide, propylene oxide, butylene oxide, hexylene oxide, or the like and tetrahydrofuran or the like may be used in combination.

Examples of the catalyst include, but not limited to, an alkali metal catalyst such as potassium compound and a cesium compound; a composite metal cyan compound complex catalyst; and a metal porphyrin catalyst. As the composite metal cyan compound complex catalyst, a complex containing zinc hexacyanocobaltate as a main component and an ether and/or alcohol complex are preferred. As a composition of the ether and/or alcohol complex, the one discussed in Japanese Patent Publication No. 46-27250 is usable. As the ether, ethyleneglycol dimethylether (grime), diethyleneglycol dimethylether (digrime), and the like are preferred, and, grime is particularly preferred from the viewpoint of handling during production of the complex. As the alcohol, the one discussed in Japanese Patent Application Laid-Open No. 4-145123 is usable, but tert-butanol is particularly preferred.

The row material polyoxyalkylene polymer may preferably have 2 or more functional groups, and specific examples thereof include a copolymer of polyoxyethylene, polyoxypropylene, polyoxybutylene, polyoxyhexylene, polyoxytetramethylene, and the like. The raw material polyoxyalkylene polymer may preferably be polyoxypropylene polyol having 2 to 6 valences, particularly preferably polyoxypropylenediol and polyoxypropylenetriol. Also, a polyoxyalkylene polymer containing in its molecule an amino group is usable.

Examples of the hydrocarbon polymer to be the main chain skeleton include a polymer having as a main monomer a monoolefin having 1 to 6 carbon atoms such as ethylene, propylene, 1-butene, isobutene, and 1-hexene and a diolefin homopolymer such as butadiene and isoprene. Also, a hydrogenated additive of a copolymer of the diolefin and the monoolefin is usable. Among the hydrocarbon polymers, the polymer containing isobutene as the main monomer and the hydrogenated additive of the butadiene polymer are preferred in view of easiness of introduction of a functional group into an end and adjustment of a molecular amount as well as capability of increasing the number of end functional groups.

As the polymer containing isobutene as the main monomer, an isobutene homopolymer and a copolymer containing 50 wt % or less, preferably 30 wt % or less, more preferably 10 wt % or less of a monomer that is copolymerizable with isobutene are usable.

As the monomer that is copolymerizable with isobutene, olefins having 4 to 12 carbon atoms, vinylether, an aromatic vinyl compound, vinylsilanes, allylsilanes, and the like are usable. Examples of the monomer include 1-butene, 2-butene, 2-methyl-1-butene, 3-methyl-1-butene, 1-pentene, 4-methyl-1-pentene, 1-hexene, vinylcyclohexene, methylvinylether, ethylvinylether, isobutylvinylether, styrene, α-methylstyrene, divinylstyrene, vinyltrimethoxysilane, vinyltriethoxysilane, allylaminotrimethylsilane, allyldimethoxysilane, and the like.

Examples of the vinyl polymer to be the main chain skeleton include a polymer of a compound having in its molecule at least one polymerizable alkenyl group. A reaction for obtaining the main chain skeleton of the vinyl polymer by polymerization of the compound having in its molecule at least one polymerizable alkenyl group is performed according to Reaction Method (4) described below.

As the polyester to be the main chain skeleton, those synthesized by the method discussed in Japanese Patent Application Laid-Open No. 2003-193019 are usable without limitation thereto.

As the polycarbonate to be the main chain skeleton, those synthesized by the method discussed in Japanese Patent Application Laid-Open No. 2002-356550, Japanese Patent Application Laid-Open No. 2002-179787, and the like are usable without limitation thereto.

As a molecular weight of the main chain skeleton of the silicone-modified resin to be used in the present exemplary embodiment, a number average molecular weight may preferably be 500 to 30,000, more preferably 1,000 to 10,000, particularly preferably 2,000 to 20,000, from the viewpoint of a coating property.

The silicone-modified resin as the compound represented by Formula (1) is a main component of the composition and contained in a ratio of 50 wt % or more.

As an adhesiveness imparting agent, b) mercaptosilane compound is used. With the use of the mercaptosilane compound, it is possible to impart excellent ink-resistant adhesiveness. Examples of the mercaptosilane compound include 3-mercaptopropylmethyldimethoxysilane, 3-mercaptopropyltrimethoxysilane, and the like. Examples of the adhesiveness imparting agents that can be added for improving adhesiveness include an aminosilane compound such as γ-aminopropyltrimethoxysilane and an epoxysilane compound such as γ-glycidoxypropyltriethoxysilane.

From the viewpoints of improvement in curing property of the composition, strength and workability of the cured product, a ratio of the mercaptosilane compound to be blended may preferably be about 0.01 to 10 wt %, particularly preferably 0.1 to 5 wt %, with respect to an entire composition.

As the curing catalyst of the compound of Formula (1), a boron trifluoride compound is used. With the use of the boron trifluoride compound, it is possible to attain a good curing property and to add the mercaptosilane compound as the adhesiveness imparting agent. Particularly, complexes of boron trifluoride are preferred from the viewpoint of handling easiness. Among the complexes of boron trifluoride, an amine complex having both of stability and catalyst activity is particularly preferred. Examples of the complexes include a piperidine complex (Formula (2)) of boron trifluoride.

(2)

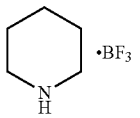

There are commercially available amine complexes of boron trifluoride, and it is possible to use them in the present exemplary embodiment. Examples of an amine compound to be used for the amine complex of boron trifluoride include, but not limited to, ammonium, monoethylamine, triethylamine, piperidine, aniline, morpholine, cyclohexylamine, n-butylamine, monoethanolamine, diethanolamine, triethanolamine, guanidine, 2,2,6,6-tetramethylpiperidine, 1,2,2,6,6-pentamethylpiperidine, N-methyl-3,3'-iminobis(propylamine), ethylenediamine, diethylenetriamine, triethylenediamine, pentaethylenediamine, 1,2-diaminopropane, 1,3-diaminopropane, 1,2-diaminobutane, 1,4-diaminobutane, 1,9-diaminononane, ATU(3,9-bis(3-aminopropyl)-2,4,8,10-tetraoxaspiro[5.5]undec ane), CTU guanamine, dihydrazide dodecanoate, hexamethylenediamine, m-xylylenediamine, dianisidine, 4,4'-diamino-3,3'-diethyldiphenylmethane, diaminodiphenylether, 3,3'-dimethyl-4,4'-diaminodiphenylmethane, a tolidine base, m-tolylenediamine, o-phenylenediamine, m-phenylenediamine, p-phenylenediamine, melamine, 1,3-diphenylguanidine, di-o-tolylguanidine, 1,1,3,3-tetramethylguanidine, bis(aminopropyl)piperazine, a compound having a plurality of primary amino group such as N-(3-aminopropyl)-1,3-propanediamine, bis(3-aminopropyl)ether, and Jeffamine manufactured by Sun Technochemical, piperazine, cis-2,6-dimethylpiperazine, cis-2,5-dimethylpiperazine, 2-methylpiperazine, N,N'-di-t-butylethylenediamine, 2-aminomethylpiperidine, 4-aminomethylpiperidine, 1,3-di-(4-piperidyl)-propane, a compound having a plurality of secondary amino groups such as 4-aminopropylaniline, homopiperazine, N,N'-diphenylthiourea, N,N'-diethylthiourea, and N-methyl-1,3-propanediamine, methylaminopropylamine, ethylaminopropylamine, ethylaminoethylamine, laurylamine propylamine, 2-hydroxyethylaminopropylamine, 1-(2-aminoethyl)piperazine, N-aminopropylpiperazine, 3-aminopyrroridine, a compound represented by H2 N (C2 H4 NH) nH (n approximately equals to 5), Poly-8 (trade name, manufactured by Tosoh Corporation), N-alkylmorpholine, 1,8-diazabicyclo[5.4.0]undecen-7, a heterocyclic tertiary amine compound such as 7-methyl-1,5,7-triazabicylco [4.4.0]deca-5-ene, an aminosilane compound such as γ-aminopropyltriethoxysilane, γ-aminopropylmethyldiethoxysilane, and 4-amino-3-dimethylbutyltriethoxysilane.

The boron trifluoride compound may be used alone or in combination of two or more kinds. A ratio of the boron trifluoride compound to be blended may preferably be about 0.001 to 10 wt %, particularly preferably 0.01 to 5 wt %, with respect to the entire compound in view of the curing property and a balance among the components.

The sealant composition is applied onto the vicinity of the electric connection portion between the electric wiring tape 6 and the electric contact substrate 7 and cured by moisture.

Figure 9:
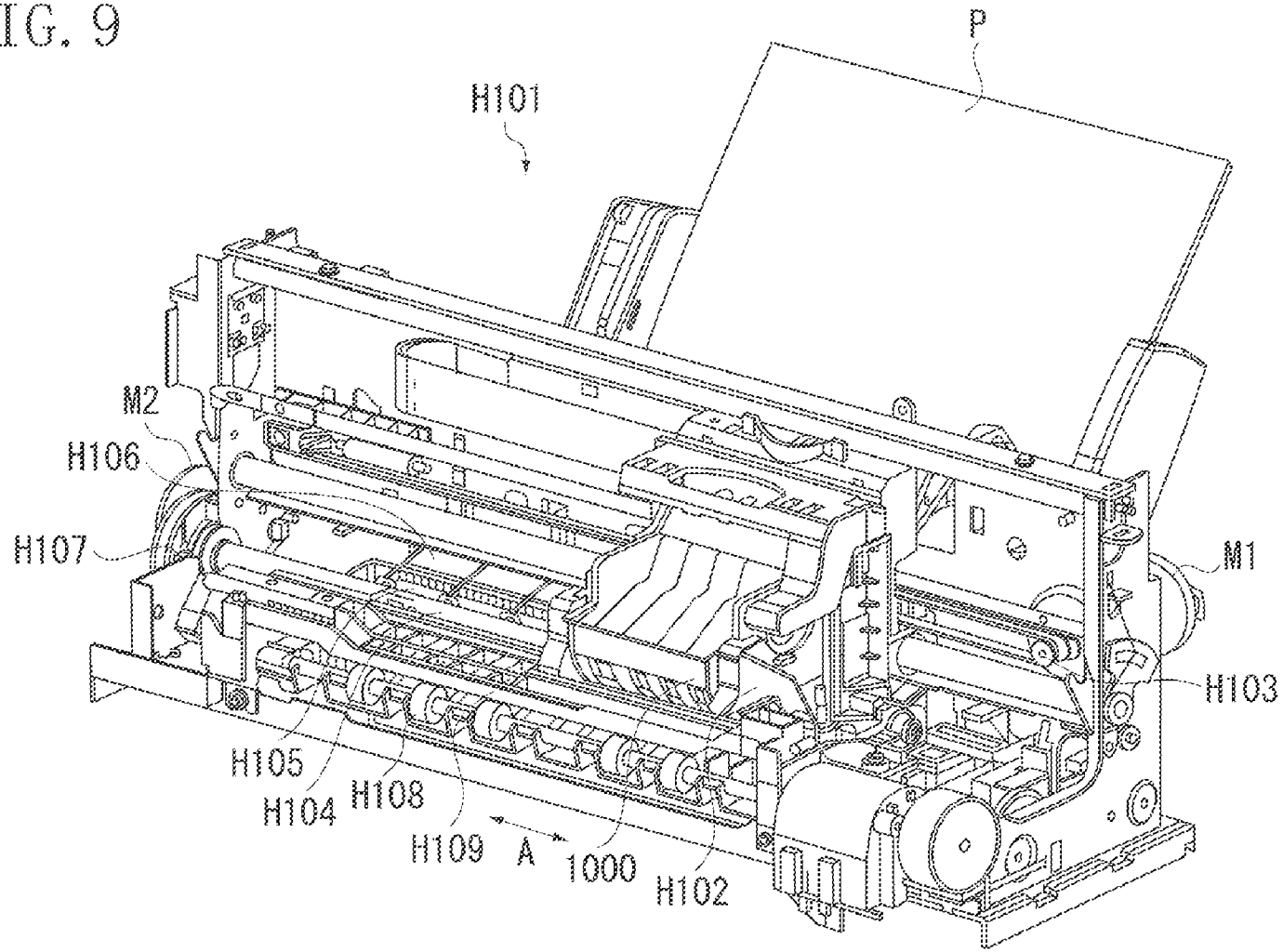
FIG. 9 is a perspective view illustrating a configuration of an inkjet apparatus according to an exemplary embodiment of the present invention.

FIG. 9 is an appearance perspective view illustrating an outline of a configuration of an inkjet apparatus H101 according to an exemplary embodiment of the present invention.

As illustrated in FIG. 9, the inkjet apparatus H101 includes an inkjet head 1000 and a main body serving as a machine having a mechanism for mounting the inkjet head 1000.

The inkjet apparatus H101 transmits a driving force generated by a carriage motor M1 from a transmission mechanism H103 to a carriage H102, to which the inkjet head 1000 is mounted, thereby causing the carriage H102 to reciprocate in the directions of two-headed arrow A. The inkjet apparatus H101 performs recording by feeding a recording medium P such as a recording sheet via a sheet feeding mechanism 5, conveying the recording medium P to a recording position, and discharging ink onto the recording medium P from the inkjet head 1000 at the recording position.

An electricity supply terminal for supplying power from a power source provided in the carriage H102 of the main body and the electric contact terminal 17 of the electric contact substrate 7 of the inkjet head 1000 are capable of attaining and maintaining required electric connection when contact surfaces thereof are brought into property contact. The inkjet head 1000 enables recording by applying energy in response to a recording signal and selectively discharging ink form a plurality of discharge ports.

The main body of the inkjet apparatus H101 is provided with a platen (not illustrated), which is located opposite to discharge port surfaces, on which the discharge ports (not illustrated) of the inkjet head 1000 are formed. The ink is discharged in response to the recording signal applied to the inkjet head 1000 simultaneously with the reciprocation of the carriage H102 caused by the driving force of the carriage motor M1, so that recording is performed over an entire width of the recording medium P conveyed onto the platen.

Referring to FIG. 9, a conveyance roller H104 is driven by a conveyance motor M2 for conveying the recording medium P. A pinch roller H105 presses the recording medium P against the conveyance roller H104 by a spring (not illustrated). A pinch roller holder H106 rotatably supports the pinch roller H105, and a conveyance roller gear H107 is fixed to one end of the conveyance roller H104. The conveyance roller H104 is driven by rotation of the conveyance motor M2 transmitted via an intermediate gear (not illustrated) to the conveyance roller gear H107.

A discharge roller H108 discharges the recording medium P on which an image is formed by the inkjet head 1000 to the outside of the recording apparatus and is driven by transmission of the rotation of the conveyance motor M2. The discharge roller H108 presses the recording medium P against a spur roller (not illustrated) by a spring (not illustrated). A spur holder H109 rotatably supports the spur roller. The recording medium P is movable on a conveyance path inside the inkjet apparatus by the above-described mechanism.

Figure 7:
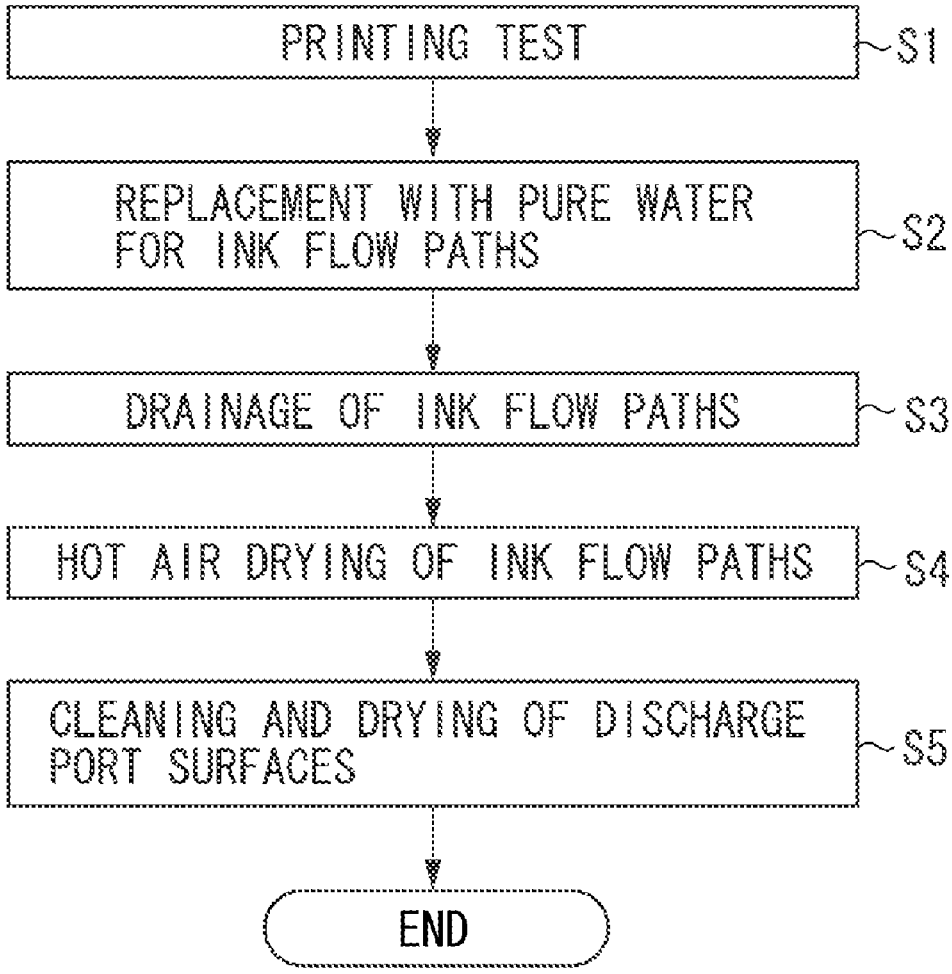
FIG. 7 is a flowchart illustrating steps of drying flow paths of the inkjet head.

In production of the inkjet apparatus, the inkjet head 1000 is processed according to the flow illustrated in FIG. 7 after the sealing member 21 is cured. In step S1, a printing test is performed after mounting ink tanks and charging inkjet head with inks. In step S2, the ink tanks are removed, and the inks in the inkjet head are replaced by pure water to eliminate the inks remaining inside. In step S3, the pure water is drained off. In step S4, the ink flow paths (in supply path 14 and paths in the discharge element substrates 2 and 3 connected to the discharge ports 60) are dried by hot air. In step S5, the discharge port surfaces are dried, and the inkjet head is mounted to the main body in a state where the ink flow paths (paths from the filter 12 to the discharge ports 60) are not charged with any liquid. Thus, it is possible to obtain the inkjet apparatus before mounting the ink tanks as illustrated FIG. 9, and it is possible to attain a packaged state for shipping by packing the inkjet apparatus in the above-described state into a cardboard box or the like together with an impact absorbing material such as cardboard and styrofoam. It is unnecessary to package with the recording medium P being set.

Since the sealing member 21 is alkylene in which the main chain has the urethane bond, it is possible to obtain a cured product without containing a volatile low molecular compound. Therefore, a gas is prevented from invading the flow paths even when the sealing member 21 is left for a long time in the packaged state where the flow paths are empty.

Hereinafter, examples of the present invention will be specifically described, but the technical scope of the present invention is not limited to the examples.

EXAMPLE 1

A reaction product S was obtained by charging a reaction vessel with 90 g of KBM903 (*2) (trade name; manufactured by Shin-Etsu Chemical Co., Ltd.) and 92 g of 2-ethylhexyl acrylate and allowing a reaction at 80° C. for 5 hours while mixing with stirring under a nitrogen atmosphere.

A polyoxyalkylene resin PU having in its molecule an isocyanate group was obtained by charging another reaction vessel with 350 g of PML4010 (*5) (trade name; manufactured by Asahi Glass Co., Ltd.,) 150 g of PR5007 (*6) (trade name; manufactured by Adeka Corporation), and 29.4 g of Desmodur I (*7) (trade name; manufactured by Sumika Bayer Urethane Co., Ltd.) and allowing a reaction at 90° C. for 4 hours while mixing with stirring under a nitrogen atmosphere. A curable resin U which is in the form of a liquid at a room temperature and is a curable polyoxyalkylene resin having in its molecule an urethane bond and a hydrolyzable silyl group was obtained by adding 60 g of the reaction product S to the polyoxyalkylene resin PU and allowing a reaction at 90° C. for one hour while mixing with stirring under a nitrogen atmosphere.

A sealant composition was prepared by adding 1 g of KBM803 (trade name; manufactured by Shin-Etsu Chemical Co., Ltd.) and 0.2 g of boron trifluoride piperidine complex to 100 g of the obtained curable resin U.

Figure 6A:
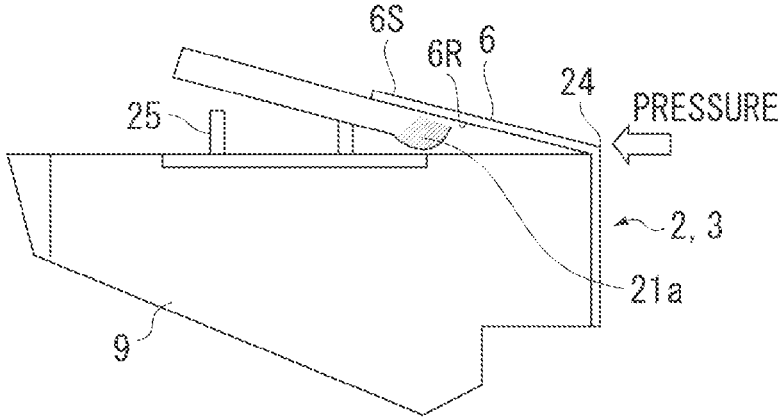
FIGS. 6A to 6C are side views illustrating an example of a method for producing the inkjet head according to an exemplary embodiment of the present invention.
Figure 6B:
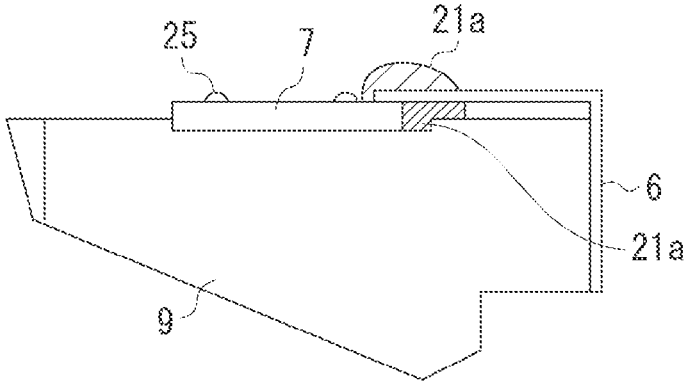

FIGS. 5 and 6A to 6C are diagrams schematically illustrating an example of states of the inkjet head during the production steps. The sealant composition 21*a* was applied from a syringe container 51 to a vicinity of the electric connection portion between the second electric connection terminal portion 18 at the reverse side 6R of the electric wiring tape and the connection terminal 23 of the electric contact substrate while pressing the electric contact substrate 7 with a pressing device 50 in a state where the discharge element substrate was faced downward. An aromatic polyamide film was formed on the reverse side 6R. As illustrated in FIG. 6A, the electric wiring tape 6 was bent at the end portion 24 of the second plate by pressurizing and heating, and the electric substrate 7 was fixed by caulking by the terminal coupling pin 25 provided in the ink supply member 9 as illustrated FIG. 6B. The sealant composition 21*a* was directly applied on the connection portion on the surface side between the second electric connection terminal portion 18 of the electric wiring tape and the connection terminal 23 of the electric contact substrate 7 by using a nozzle or the like. A material of the surface 6S of the electric wiring tape was polyimide, and a material of the surface of the electric contact substrate 7 was an acryl resin.

Figure 6C:
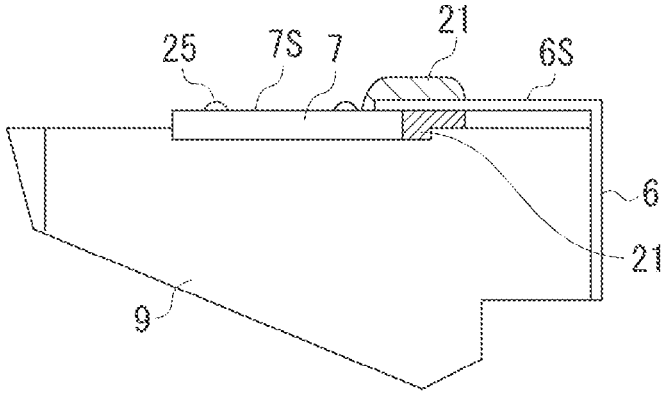

The sealant composition 21*a* was cured by hydrolysis and condensation of the main ingredient by moisture to become the sealing member 21 (FIG. 6C). An inkjet head was produced by performing the above production steps. The inkjet head was charged with inks to confirm that the printing function was free from issue. This inkjet head is hereinafter referred to as inkjet head A-1.

As illustrated in the flowchart of FIG. 7, ink tanks were mounted to the inkjet head, followed by charging inks, and the printing test (S1) was performed to confirm that the printing function was free from issues. After that, the ink tanks were removed, and the inks in the inkjet head were replaced by pure water (S2), and the pure water was drained off (S3), followed by drying the ink flow paths by hot air (S4). The discharge port surfaces were dried (S5). This inkjet head is hereinafter referred to as inkjet head B-1.

The inkjet head before performing the flow illustrated in FIG. 7 is referred to as inkjet head A-(number), and the inkjet head underwent the flow illustrated in FIG. 7 is referred to as inkjet head B-(number).

EXAMPLE 2

Inkjet heads A-2 and B-2 were produced in the same manner as in Example 1 except for changing the use amount of KBM803 (*1) (trade name; manufactured by Shin-Etsu Chemical Co., Ltd.) to 0.01 g with respect to 100 g of the curable resin U.

EXAMPLE 3

Inkjet heads A-3 and B-3 were produced in the same manner as in Example 1 except for changing the use amount of KBM803 (*1) (trade name; manufactured by Shin-Etsu Chemical Co., Ltd.) to 10 g with respect to 100 g of the curable resin U.

EXAMPLE 4

Inkjet heads A-4 and B-4 were produced in the same manner as in Example 1 except for changing the use amount of boron trifluoride piperidine complex to 0.01 g with respect to 100 g of the curable resin U.

EXAMPLE 5

Inkjet heads A-5 and B-5 were produced in the same manner as in Example 1 except for changing the use amount of boron trifluoride piperidine complex to 0.01 g with respect to 10 g of the curable resin U.

COMPARATIVE EXAMPLE 1

A sealant composition was prepared by adding 1 g of KBM903 (*2) in place of KBM803 (*1) (trade name; manufactured by Shin-Etsu Chemical Co., Ltd.) and 0.2 g of the boron trifluoride piperidine complex with respect to 100 g of the curable resin U.

Inkjet heads A-6 and B-6 were produced in the same manner as in Examples by using the sealant composition.

COMPARATIVE EXAMPLE 2

1 g of KBM903 (*2) was used in place of KBM803 (*1) (trade name; manufactured by Shin-Etsu Chemical Co., Ltd.) with respect to 100 g of the curable resin U. A sealant composition was prepared by adding 0.2 g of Neostan U-303 (*3) (trade name; manufactured by Nitto Kasei Kogyo K. K.) in place of the boron trifluoride piperidine complex.

Inkjet heads A-7 and B-7 were produced in the same manner as in Examples by using the sealant composition.

COMPARATIVE EXAMPLE 3

SE9186L (*4) (trade name; manufactured by Dow Corning Toray Co., Ltd.) was used as a sealant composition. Inkjet heads A-8 and B-8 were produced in the same manner as in Examples by using the sealant composition.

COMPARATIVE EXAMPLE 4

A sealant composition was prepared by adding 0.2 g of Neostan U-303 (trade name; manufactured by Nitto Kasei Kogyo K. K.) in place of the boron trifluoride piperidine complex with respect to 100 g of the curable resin U.

However, since the sealant composition was not cured under an atmosphere of a temperature of 25° C. and humidity of 50%, it was impossible to produce an inkjet head.

(Printing Evaluation)

The inkjet heads of Examples 1 to 5 and Comparative Examples 1 to 3 and 30 g of each of the sealant compositions used for the inkjet heads were placed on a glass petri dish and packaged into a teflon jar (500 mL), followed by storage at 60° C. for 2 weeks. After that, the printing test was performed to obtain printing evaluation A of the inkjet heads A-1 to A-8 and printing evaluation B of the inkjet heads B-1 to B-8.

(Evaluation Standard)

○: Capable of good printing

Δ: Discharge port (s) failed to discharge and adversely influenced on printing (Adhesiveness Evaluation)

A substrate A in which an acrylic resin (PSR-4000 manufactured by Taiyo Ink Mfg, Co., Ltd.) which is an example of a surface coating resin of the electric contact substrate 7 was provided on a surface was prepared. A substrate B in which a polyimide film (Upilex manufactured by Ube Industries, Ltd.) which is an example of a surface coating resin of the electric wiring tape is provided on a surface was prepared. Ink-resistant adhesiveness of the sealing member 21 to the electric wiring tape 6 and the electric contact substrate 7 was evaluated by using the substrate A and substrate B.

Figure 8:
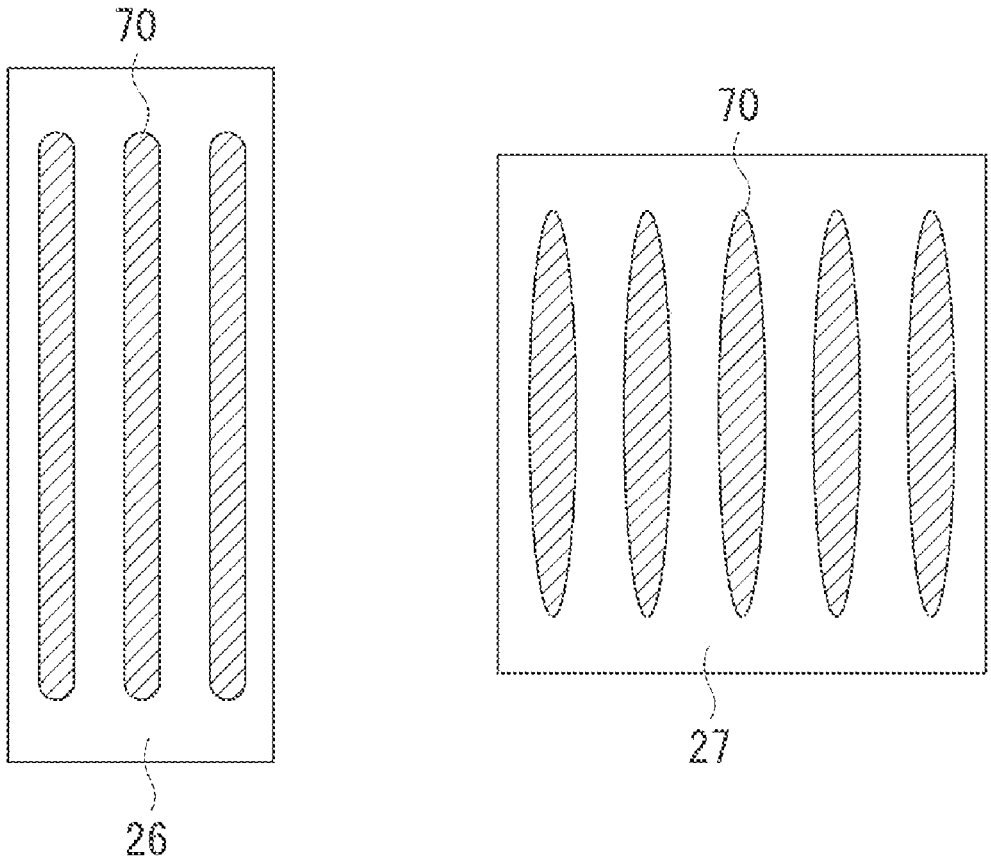
FIG. 8 is a diagram illustrating a state in which a sealant composition is applied on a resin substrate covering the electric contact substrate and a polyimide film substrate.

As illustrated in FIG. 8, each of the sealant compositions used in Examples 1 to 5 and Comparative Examples 1 to 3 was applied on the substrate A 26 and the substrate B 27, followed by curing under an atmosphere of at a temperature of 25° C. and humidity of 50% for one week, thereby obtaining cured products 70. 10 samples of each of the cured products 70 were prepared, and the samples were dipped into inkjet color inks BCI7 (trade name; manufactured by Canon Inc.) and stored at 60° C. for 3 months. Ink adhesiveness A of the substrate A and ink adhesiveness B of the substrate B were evaluated.

(Evaluation Standard)

⊙: Detachment of sealant composition was not observed in all of samples

○: Large part of sealant composition was in close contact with very few small detachment portions Δ: Detachment of sealant composition was observed in half or more of the samples The above-described evaluations are summarized in Table 1.

TABLE 1

| | | Examples | | | | | Comparative Examples | | | |
|---|---|---|---|---|---|---|---|---|---|---|
| | | 1 | 2 | 3 | 4 | 5 | 1 | 2 | 3 | 4 |
| Sealant composition (unit of numerical value is part by weight) | Curable resin U | 100 | 100 | 100 | 100 | 100 | 100 | 100 | | 100 |
| | KBM803 *1 | 1 | 0.01 | 10 | 1 | 1 | | | | 1 |
| | KBM903 *2 | | | | | | 1 | 1 | | |
| | Boron trifluoride piperidine complex | 0.2 | 0.2 | 0.2 | 0.01 | 10 | 0.2 | | | |
| | Neostan U-303 *3 | | | | | | | 0.2 | | 0.2 |
| | SE9186L *4 | | | | | | | | 100 | |
| Evaluation items | Discharge evaluation A | ○ | ○ | ○ | ○ | ○ | ○ | ○ | ○ | Not cured and not evaluated |
| | Discharge evaluation B | ○ | ○ | ○ | ○ | ○ | ○ | ○ | Δ | |
| | Adhesiveness evaluation A | ⊙ | ○ | ○ | ○ | ○ | Δ | Δ | Δ | |
| | Adhesiveness evaluation B | ⊙ | ○ | ○ | ○ | ○ | Δ | Δ | Δ | |

Trade names in the above description are as follows:

*1 KBM803: trade name, manufactured by Shin-Etsu Chemical Co., Ltd., γ-mercaptopropyltrimethoxysilane;

*2 KBM903: trade name, manufactured by Shin-Etsu Chemical Co., Ltd., γ-aminopropyltrimethoxysilane;

*3 Neostan U-303: trade name, manufactured by Nitto Kasei Kogyo K. K., dialkyltin bistriethoxysilicate;

*4 SE9186L: trade name, manufactured by Dow Corning Toray Co., Ltd., One-part moisture curable silicone resin;

*5 PML4010: polyoxypropylene polyol having a number average molecular weight of 10,000;

*6 PR5007: trade name, manufactured by Adeka Corporation, polyoxyethylene-containing polyoxypropylene polyol; and

*7 Desmodur I: trade name, manufactured by Sumika Bayer Urethane Co., Ltd., 3-isocyanatemethyl-3,5,5-trimethylcyclohexyl-isocyanate.

In the evaluation of the discharge evaluation A of Table 1, no difference was observed in discharge performance of the inkjet heads of Examples 1 to 5 and Comparative Examples 1 to 3. However, in the discharge evaluation B, non-discharge occurred in high duty printing in Comparative Example 3. It is considered that the non-discharge occurred due to insufficient ink refill speed which was caused since, though outgas did not invade the flow paths in a state where the inks were charged, low molecular siloxane generated from the silicone resin invaded the flow paths in the head in a state where the flow paths were empty to make a part of the flow paths hydrophobic.

As is apparent from the evaluations of adhesiveness, good adhesiveness was confirmed in each of Examples 1 to 5 with the use of the substrate A (made from polyimide film) and the substrate B (made from electric contact substrate coating resin). It is considered that the good adhesiveness was attained since invasion by the inks was prevented due to the improvement in adhesiveness between the substrate and the sealant composition attained by the addition of the mercaptosilane compound as the adhesiveness imparting agent.

It is considered that the low curing property of Comparative Example 4 was caused by deactivation of Neostan U-303, which is the dialkyltin compound by the thiol group of KBM803. In other words, the use of the boron trifluoride compound as the curing catalyst enables using the mercaptosilane compound as the adhesiveness imparting agent without deteriorating the curing property.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-015853 filed Jan. 27, 2010, which is hereby incorporated by reference herein in its entirety.

What is claimed is:

1. An inkjet head comprising:

a discharge element substrate including a base material provided with an energy generation element for generating energy to be used for discharging ink, a discharge port provided corresponding to the energy generation element, and an electrode pad electrically connected to the energy generation element;

an electric contact substrate including an electric contact terminal for receiving an electric signal from an inkjet apparatus; and an electric wiring tape having a terminal electrically connected to the electrode pad, for electrically connecting the electric contact substrate and the discharge element substrate to each other, wherein a sealing member sealing a vicinity of an electric connection portion between the electric contact substrate and the electric wiring tape is a cured product of a composition including a compound having a structure represented by Formula (1), a boron trifluoride compound, and a mercaptosilane compound:

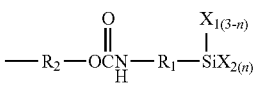

(1)

where n is 1 or more and 3 or less; $X_1$ is a substituted or unsubstituted organic group having 1 to 20 carbon atoms; $X_2$ is a hydrolyzable group; $R_1$ is a divalent organic group having a molecular weight of 1000 or less; and $R_2$ is at least one selected from the group consisting of polyoxyalkylene, a saturated hydrocarbon polymer, a vinyl polymer, polyester, and polycarbonate.

2. The inkjet head according to claim 1, wherein the electric wiring tape includes a first surface formed of a polyimide film and a second surface formed of an aromatic polyamide film, wherein the electric contact substrate includes a third surface formed of an acrylic resin film, and wherein the sealing member is in contact with the first surface, the second surface, and the third surface.

3. The inkjet head according to claim 1, wherein the mercaptosilane compound is γ-mercaptopropyltrimethoxysilane.

4. A method for producing an inkjet apparatus, the method comprising:

causing the inkjet head according to claim 1 to discharge ink;

eliminating the ink inside the inkjet head; and mounting the inkjet head to a machine provided with an electricity supply terminal for supplying electricity from a power source to the electric contact substrate and a conveyance path for a medium that receives the discharged ink.

5. An inkjet apparatus comprising:

the inkjet head according to claim 1 including an ink flow path communicating with the discharge port and the discharge element substrate in a state where the flow path is not charged with any liquid;

an electricity supply terminal for supplying electricity from a power source to the electric contact substrate; and a conveyance path for a medium that receives the discharged ink, wherein the electricity supply terminal and the electric contact terminal are in contact with each other.

* * * * *